United States Patent [19]

Hoffman et al.

[11] 4,407,886

[45] Oct. 4, 1983

[54] PRESSURE-SENSITIVE AND HEAT-SENSITIVE RECORDING MATERIAL

[75] Inventors: Dietrich Hoffman, Roedersheim-Gronau; Holger Schöpke, Ludwigshafen, both of Fed. Rep. of Germany

[73] Assignee: BASF Aktiengesellschaft, Rheinland-Pfalz, Fed. Rep. of Germany

[21] Appl. No.: 316,445

[22] Filed: Oct. 29, 1981

[30] Foreign Application Priority Data

Nov. 24, 1980 [DE] Fed. Rep. of Germany ..... 3044120

[51] Int. Cl.[3] ..... B41M 3/12; B41L 1/20

[52] U.S. Cl. ..... 428/320.8; 282/27.5; 427/150; 427/151; 428/321.1; 428/321.5; 428/327

[58] Field of Search ..... 427/148, 150, 151; 428/327, 914, 320.8, 321.1, 321.5; 282/27.5

[56] References Cited

U.S. PATENT DOCUMENTS

| | | | |
|---|---|---|---|
| 3,322,557 | 5/1967 | Schwab . | |
| 3,466,184 | 9/1969 | Bowler et al. . | |
| 3,488,207 | 1/1970 | Vassiliades . | |
| 3,669,711 | 6/1972 | Kimura et al. . | |
| 3,743,619 | 7/1973 | Kooguchi et al. . | |
| 3,843,383 | 10/1974 | Ishige et al. . | |
| 3,883,557 | 5/1975 | Farber et al. . | |
| 3,896,126 | 7/1975 | Oberlinner et al. . | |
| 3,896,128 | 7/1975 | Kast et al. . | |
| 3,900,215 | 8/1975 | Kato et al. . | |
| 3,934,070 | 1/1976 | Kimura et al. . | |
| 3,971,808 | 7/1976 | Baumann et al. . | |
| 4,082,713 | 4/1978 | Kelley | 427/150 |
| 4,263,047 | 4/1981 | Miyamoto et al. | 427/150 |
| 4,327,148 | 4/1982 | Toyama et al. | 427/150 |

FOREIGN PATENT DOCUMENTS

| | | |
|---|---|---|
| 2064155 | 4/1980 | Fed. Rep. of Germany . |
| 2631832 | 5/1981 | Fed. Rep. of Germany . |
| 2758122 | 7/1981 | Fed. Rep. of Germany . |
| 2805763 | 8/1981 | Fed. Rep. of Germany . |
| 2918593 | 9/1981 | Fed. Rep. of Germany . |
| 2940786 | 10/1981 | Fed. Rep. of Germany . |
| 3235 | 12/1978 | European Pat. Off. . |
| 1338617 | 1/1979 | United Kingdom . |
| 1417695 | 3/1979 | United Kingdom . |
| 1459417 | 6/1979 | United Kingdom . |
| 2033417 | 4/1980 | United Kingdom . |

OTHER PUBLICATIONS

"The Chemistry of Phenolic Resins" R. W. Martin; John Wiley & Sons, Inc. 1956; pp. 87, 88, 99–112.

*Primary Examiner*—Norman Morgenstern
*Assistant Examiner*—Janyce A. Bell
*Attorney, Agent, or Firm*—Oblon, Fisher, Spivak, McClelland & Maier

[57] ABSTRACT

A pressure-sensitive and heat-sensitive recording material which comprises a carrier bearing a color-developing coating consisting of (a) a finely divided solid phenolic resin with spherical particles of size $\leqq 5$ μm, (b) a copolymer as the dispersant, obtained from (α) a compound of the formula $$R^1-O-(C_2H_4O)_n-(CH_2-\underset{\underset{CH_3}{|}}{CH}-O)_m-\underset{\underset{O}{\|}}{C}-\underset{\underset{R^2}{|}}{C}=CH_2$$

where $R^1$ is $C_8$–$C_{20}$-alkyl, phenyl or $C_1$–$C_{20}$-alkylphenyl, $R^2$ is hydrogen or methyl, n is from 2 to 100 and m is from 0 to 50, and (β) an ethylenically unsaturated copolymerizable carboxylic acid, sulfonic acid or phosphonic acid, with or without (γ) an additional ethylenically unsaturated copolymerizable compound different from (α) and (β), and (c) one or more aliphatic alcohols which are solid at room temperature, with or without (d) other auxiliaries.

The coating, used in conjunction with micro-encapsulated color formers, gives sharp and intense copies.

12 Claims, No Drawings

PRESSURE-SENSITIVE AND HEAT-SENSITIVE RECORDING MATERIAL

The present invention relates to a pressure-sensitive and heat-sensitive recording material.

As a rule, the non-carbon copying papers used at the present time consist of a combination of sheets. The top sheet carries a coating of microcapsules on its rear face, and the intermediate sheets also each carry a microcapsule coating on the rear face (ie. the donor face or CB face), whilst on the front face (acceptor face or CF face) they carry an acidic compound (electron acceptor), with which the color formers react, producing the color. It is also possible to apply the microcapsules containing the color former, and the acceptor, one above the other onto the same face of the sheet. In that case, a color is formed under all circumstances when the microcapsules are destroyed.

The color formers are known. Specific examples are crystal violet lactone, N-benzoyl-leuco-methylene blue, malachite green lactone, rhodamine lactone, spirodipyranes or fluorane derivatives (cf. German Laid-Open Applications DOS Nos. 2,422,899; 2,025,171; 2,318,403 and 2,323,803, German Published Application DAS No. 2,156,214, German Laid-Open Applications DOS Nos. 2,243,483 and 2,230,225 and British Pat. No. 1,417,695).

Suitable electron acceptors include activated clays, attapulgite, alumina, bentonite, Silton clay, kaolin and other clays.

It is known, from U.S. Pat. Nos. 3,222,557 and 3,488,207, that a color is also developed with solid aromatic carboxylic acids. According to German Laid-Open Application DOS No. 2,152,765 the salts of aromatic carboxylic acids, especially of hydroxycarboxylic acids, with polyvalent metals, eg. magnesium, zinc, calcium, cadmium or aluminum, are more effective than the free carboxylic acids.

German Pat. Nos. 2,252,901 and 2,303,405 describe the use of clays and mixtures thereof with aromatic carboxylic acids and/or metal salts thereof as acceptors.

The acceptors are first converted to an aqueous dispersion by milling and mixing and, where necessary, dispersing, and are then applied to the paper surface by knife-coating or by printing.

Because of the sensitivity of the inorganic acceptors towards moisture, attempts have been made in recent years to use phenolic resins as acceptors. U.S. Pat. No. 3,466,184 describes the use of oil-soluble phenolic polymers on the acceptor face. The resins used are novolacs based on p-phenylphenol, alkylphenols and alkylphenol-acetylene resins, which are soluble in ethylene glycol monoethyl ether, n-butanol, ethyl acetate, ethanol, mixtures of these and similar solvents.

The polymers can be applied as an organic solution, for example by flexographic printing.

German Laid-Open Application DOS No. 2,631,832 describes low molecular weight condensates of hydroxybenzenecarboxylic acids or hydroxynaphthalenecarboxylic acids, phenols and formaldehyde, used as acceptors and applied to the paper from organic solution. These acceptors may or may not be used conjointly with salts which are soluble in organic solvents.

The acceptors known from U.S. Pat. No. 3,466,184 and German Laid-Open Application DOS No. 2,631,832 have the disadvantage that they must be applied as a solution in an organic solvent, necessitating the provision of extraction equipment to remove the solvent vapors.

Furthermore it is not possible—because of the presence of the organic solvent —to apply these acceptors conjointly with the aqueous microcapsules so as to produce a self-contained paper, since the microcapsules are as a rule unstable to solvents and accordingly discoloration occurs. Hence, a self-contained paper can only be prepared by first applying the acceptor and then, when the solvent has been completely removed, applying the microcapsules in a second step. The self-contained paper obtained has the disadvantage that it is very sensitive to rubbing, because the capsules rest unprotected on the resin particles.

German Published Application DAS No. 2,064,155 discloses the use of phenol-formaldehyde resins as acceptors, the resin being converted to an aqueous dispersion in the presence of an anionic dispersant. The dispersion is prepared in a conventional manner by wet-milling of the resin in aqueous suspension. The particle size should be 5 μm or less, preferably ≦1 μm, to obtain an effective acceptor layer. The fine particles can also be obtained by dissolving the phenol-formaldehyde resin in an alkali metal hydroxide solution and precipitating the resin therefrom with acid, after which the mixture is wet-milled. These finely divided resins can be isolated by spray drying of the dispersion or by use of a drum drier.

The inorganic or organic substances used as acceptors often contain sharp-edged agglomerates which on application, for example by printing, cause corrosion and abrasion of the printing equipment.

It is an object of the present invention to provide a pressure-sensitive and heat-sensitive recording material having a coating which reacts with the color former, which coating contains the electron acceptor in a uniform size and non-abrasive form and permits the production of a self-contained paper in a single pass.

This object is achieved, according to the invention, if secondary dispersions of phenolic resins, which contain spherical resin particles of diameter ≦5 μm, preferably of from 0.5 to 2 μm, and aliphatic alcohols which are solid at room temperature are used to prepare the color-developing layer.

We have found that a pressure-sensitive and heat-sensitive recording material has excellent properties if it carries, as a color-developing coating, (a) a finely divided solid phenolic resin with spherical particles of size ≦5 μm, (b) as the dispersant, a copolymer containing, as copolymerized units, (α) from 5 to 95% by weight of a copolymerizable compound of the formula $$R^1-O-(C_2H_4O)_n-(CH_2-\underset{\underset{CH_3}{|}}{CH}-O)_m-\underset{\underset{O}{\|}}{C}-\underset{\underset{R^2}{|}}{C}=CH_2$$

where $R^1$ is $C_8$–$C_{20}$-alkyl or unsubstituted or $C_1$–$C_{20}$ alkyl-substituted phenyl, $R^2$ is hydrogen or methyl, n is from 2 to 100 and m is from 0 to 50, (β) from 5 to 95% by weight of a copolymerizable ethylenically unsaturated $C_3$–$C_5$-carboxylic acid or of a sulfonic acid or phosphonic acid carrying a polymerizable ethylenically unsaturated group, and (γ) from 0 to 50% by weight of one or more copolymerizable ethylenically unsaturated compounds different from (α) and (β), and (c) one or more aliphatic alcohols which are solid at room temperature, with or without (d) other auxiliaries conventionally present in such coatings, (a) together with (b) having been applied in the form of an aqueous or aqueous-organic secondary dispersion.

The color-developing coating according to the invention gives pressure-sensitive or heat-sensitive recording materials which, together with micro-encapsulated color formers, give sharp, intense and stable copies or recordings.

The recording material according to the present invention is obtained by applyng an aqueous or aqueous-organic preparation, containing components (a), (b) and (c), with or without (d), to the carrier.

The aqueous or aqueous-organic preparation is obtained by mixing the secondary dispersion, containing (a) and (b), and the aliphatic alcohol which is solid at room temperature, with or without other auxiliaries conventionally present in such coatings.

The requisite aqueous or aqueous-organic secondary dispersion of (a) and (b) is obtained by introducing a solution of the phenolic resin (novolac) in a water-miscible solvent into water in which the copolymer dispersant (b) is dissolved or suspended, with vigorous mixing. The particle size of (a) can be influenced by the precipitation temperature, the solvent used and the stirring equipment employed, for example a propellor stirrer, mixing turbine or high-efficiency stirrer. Round particles of (a), of size from 0.2 to 5 μm, preferably from 0.5 to 2 μm, are particularly suitable for the recording material according to the invention. Smaller particles of (a), especially of ≦0.2 μm, tend to disappear between the paper fibers when the dispersion is applied to the paper, and are accordingly available only partially, if at all, for color development.

For economic reasons, suitable water-miscible solvents to use for (a) are ethanol, n-propanol, i-propanol, methanol, butanol, tetrahydrofuran, acetone and mixtures of these.

The organic solvent can, if necessary, be partially or completely removed from the dispersion by conventional methods, for example by distillation.

Suitable dispersants (b) are copolymers which contain, as copolymerized units, (α) from 5 to 95% by weight of a copolymerizable compound of the formula

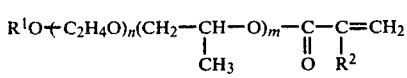

$$R^1O\text{-}(C_2H_4O)_n(CH_2-\underset{\underset{CH_3}{|}}{CH}-O)_m-\underset{\underset{O}{\|}}{C}-\underset{\underset{R^2}{|}}{C}=CH_2 \quad (I)$$

where $R^1$ is $C_8$–$C_{20}$-alkyl or unsubstituted or $C_1$–$C_{20}$-alkyl-substituted phenyl, $R^2$ is hydrogen or methyl, n is from 2 to 100 and m is from 0 to 50, (β) from 5 to 95% by weight of a copolymerizable ethylenically unsaturated $C_3$–$C_5$-carboxylic acid or of a sulfonic acid or phosphonic acid containing a polymerizable ethylenically unsaturated group, and (γ) from 0 to 50% by weight of one or more copolymerizable ethylenically unsaturated compounds different from (α) and (β).

Specific examples of $R^1$ in the comonomer (α) are radicals derived from $C_8$–$C_{20}$-alkanols, especially $C_{10}$–$C_{20}$-alkanols, eg. octyl, 2-ethylhexyl, nonyl, palmityl, stearyl, oleyl and lauryl, and radicals derived from phenol or from $C_1$–$C_{20}$-alkylphenols, eg, hexylphenyl, dodecylphenyl, hexadecylphenyl and octadecylphenyl.

Preferred radicals $R^1$ are those derived from tallow alcohol, coconut alcohol or $C_5$–$C_{18}$-alkylphenols.

In the comonomer of the formula (I), n is preferably from 10 to 100, and m is preferably 0.

Suitable comonomers (β) include $C_3$–$C_5$-carboxylic acids, eg. acrylic acid, methacrylic acid, crotonic acid and vinylacetic acid, and unsaturated sulfonic acids and phosphonic acids, eg. vinylsulfonic acid, sulfoethylacrylic acid, sulfoethyl-methacrylic acid, sulfopropylacrylic acid, sulfopropyl-methacrylic acid, maleimide-N-ethanesulfonic acid, 2-acrylamido-2-methylpropanesulfonic acid and vinylphosphonic acid.

Preferred comonomers (β) used in (b) are acrylic acid, methacrylic acid and 2-acrylamido-2-methylpropanesulfonic acid.

Examples of suitable comonomers (γ) which may be present are acrylamide, methacrylamide, lauryl acrylate, styrene, vinyl acetate, methyl acrylate, methyl methacrylate, tert.-, sec.- or n-butyl acrylate, hydroxypropyl acrylate, butanediol monoacrylate, vinyl propionate and 2-ethylhexyl acrylate, amongst which acrylamide, the butyl acrylates, 2-ethylhexyl acrylate, hydroxypropyl acrylate and lauryl acrylate are preferred.

Particularly preferred copolymers are those of the acrylate of a reaction product of tallow alcohol with from 40 to 90 moles of ethylene oxide, acrylamide and 2-acrylamido-2-methylpropanesulfonic acid, and copolymers of the said modified tallow alcohol acrylate with lauryl acrylate and methacrylic acid, as well as copolymers of the said modified tallow alcohol acrylate with about 30% by weight of methacrylic acid.

The copolymer (b) is prepared as described in German Laid-Open Application DOS No. 2,758,122.

The amount of dispersant (b) is in general from 1 to 10, preferably from 2 to 8, especially from 3 to 8, by weight, based on resin (a).

Suitable phenolic resins (a) are those of the novolac type, obtained by condensing phenol with formaldehyde or isobutyraldehyde in a molar ratio of from 1 : 0.5 to 1:1. The preparation of these resins is known (Robert W. Martin "The Chemistry of Phenolic Resins", John Wiley and Sons, Inc. 1956; German Laid-Open Applications DOS Nos. 2,805,763 and 2,918,593).

Suitable aliphatic alcohols which are solid at room temperature are those of 12 to 18 carbon atoms, the alkyl radicals being linear or branched. Mixtures of these alcohols may also be used.

Specific examples of suitable alcohols are lauryl alcohol, myristyl alcohol, cetyl alcohol, stearyl alcohol and mixtures prepared from $C_{11}$–$C_{18}$-cuts. Cetyl Alcohol and myristyl alcohol are preferred.

Examples of further auxiliaries (d) are products with which the viscosity of the formulation containing (a), (b) and (c) can be adjusted, as well as binders, eg. starch and soluble cellulose derivatives, binder dispersions based on acrylate or styrene-butadiene copolymers, white pigments and fillers, eg. insoluble starch, insoluble melamine-formaldehyde condensates, hollow microspheres, titanium dioxide, calcium carbonate and clay.

The coating of (a), (B), (C) and (D) can be applied to the carrier in a conventional manner, for example in the form of an aqueous or aqueous-organic dispersion. If microencapsulated color formers are also added to the dispersion, self-contained recording materials are obtained.

The Examples which follow illustrate the invention. Parts and percentages are by weight.

A. DISPERSANT 1. 954 parts of isopropanol, 954 parts of water, 315 parts of the acrylate of a reaction product of tallow alcohol with 80 moles of ethylene oxide, 105 parts of 2-acrylamido-2-methylpropanesulfonic acid and 210 parts of acrylamide were introduced into a Witt vessel with water-bath, anchor stirrer, thermometer and $N_2$ connection. A solution was prepared by stirring the mixture under nitrogen, whilst heating to 60° C. 21 parts of azodiisobutyronitrile were then added and the mixture was kept at 80° C. for 3 hours.

The polymer solution, when cold, had a solids content of 26%. The polymer had a Fikentscher K value of 36 (measured on a 3% strength solution in dimethylformamide (DMF)).

2. The procedure followed was as for dispersant 1, but 315 parts of isopropanol, 315 parts of water, 140 parts of the acrylate of a reaction product of tallow alcohol with 80 moles of ethylene oxide, 70 parts of methacrylic acid and 7 parts of azobisisobutyronitrile were used.

The polymer solution obtained had a solids content of 25%, and a Fikentscher K value (3% strength in DMF) of 32.

B. ASSESSMENT OF THE RECORDING MATERIAL OF THE PRESENT INVENTION

1. Determination of the intensity of the copy

A commercial microcapsule-coated paper (CB paper) was assembled together with sheets of the recording material according to the invention (CF paper) to form an 8-copy set, and the letter "w" was typed onto a 4×4 cm area of this set on an electric typewriter, with pressure setting 2. The letters were typed in immediate succession in each line, and the successive lines were closely spaced.

The 8th copy was used to determine the intensity. For this purpose, the reflectance of the blank coated paper and of the written-on coated paper were measured relative to the reflectance of a white standard (taken as=100), using a reflectance photometer from Zeiss (®Elrepho), with a Y filter.

The intensity of the copy (IC) is given by $IC=R_{yo}-R_{ym}$, where $R_{yo}$ is the reflectance of the blank paper and $R_{ym}$ the reflectance of the written-on paper, in each case relative to the white standard and determined with the Y filter.

2. Assessment of script sharpness

The 8th copy was used, since the fuzziness increases from copy to copy. The assessment is in terms of ratings 1 to 5, with the following meanings:

1=sharp copy
2=slightly fuzzy
3=fuzzy
4=blurred
5=very blurred.

EXAMPLE 1

(a) Dispersion 140 parts of a phenol-formaldehyde novolac resin (molar ratio of phenol:formaldehyde=1:0.75; molecular weight 500; softening point 104° C. (determined by the ring-and-ball method of DIN 52,011; readily soluble in alkanols and ketones) and 20 parts of cetyl alcohol are dissolved in 210 parts ethanol. 28 parts of the solution of dispersant 1 (=7.28 parts of dispersant) are then stirred in and the solution obtained is introduced into a vessel equipped with a disperser (®Ultra-Turrax). 300 parts of water at room temperature are added slowly, whilst stirring at 6,000 rpm; the temperature at the end of the addition is about 40° C. The organic solvents are then removed from the dispersion in a distillation apparatus.

A stable phenolic resin dispersion, which is stable for several weeks, is obtained.

Solids content: 36%; diameter of the spherical particles≈1 μm.

(b) Coating composition

The dispersion obtained according to (a) is mixed with 10% (based on dispersion solids) of edible starch and 5% (based on dispersion solids) of a 50% strength styrene/butadiene copolymer binder dispersion. The mixture is then diluted with water so that the coating material has a flow time of 30 s in a DIN Ford cup with 4 mm nozzle.

The coating composition was knife-coated in an amount of 5.1 g/m² onto paper weighing 40 g/m².

Copies were then prepared, as described in B1, with the coated recording material obtained, and the intensity and sharpness of the 8th copy were assessed as described in B1 and B2.

IC=40; sharpness: rating 1.

EXAMPLES 2 TO 5

(a) Dispersion

The procedure described in Example 1(a) is followed, but a phenol-isobutyraldehyde novolac resin (molar ratio 1:1; molecular weight 650; softening point 120° C., by the DIN 52,011 ring-and-ball method; readily soluble in alkanols and ketones) was employed. The amount of cetyl alcohol dissolved together with the resin is shown in the Table below.

| Example | Parts | |
|---|---|---|
| 2 | 10 | cetyl alcohol |
| 3 | 20 | |
| 4 | 35 | |
| 5 | 70 | |

(b) Coating materials were prepared with the dispersions, using the method in Example 1(b), and the coated recording material was tested, as described in B1 and B2, for intensity and sharpness of the 8th copy.

In combination with commercial microcapsule papers, sharp and intense copies were obtained. The best result is achieved if 20 parts of cetyl alcohol are added.

IC=45, sharpness: rating 1.

EXAMPLE 6 TO 9

(self-contained coating)

(a) The resin dispersions of Examples 2(a) to 5(a) are used.

(b) Coating composition 45 parts of a 50% strength binder dispersion based on butadiene/styrene copolymer, 80 parts of mechanically ground cellulose and 13 parts of thickener based on polyacrylic acid are introduced into each of the dispersions of Examples 2(a) to 5(a), and the homogeneous resulting dispersion is brought to pH 8 with sodium hydroxide solution.

Sufficient of a 40% microcapsule dispersion relative to phenolic resin are added to the mixtures obtained to give a weight ratio of resin: microcapsules =2:1.

The microcapsule dispersion was prepared by the method described in Example 1 of German Laid-Open Application DOS No. 2,940,786.

To prepare the coating composition, each mixture was diluted with water to about 30 s flow time in a Ford cup with 4 mm nozzle. The results of the tests on the recording materials obtained with the above compositions are shown in Table I below.

(c) If the ratio of resin to microcapsules in the coating composition, or in the preparation from which the coating composition is obtained by dilution to a suitable viscosity, is increased to 1:1 or 1:2, the recording material obtained gives a high IC (49.5–62) on the 8th copy, but the script on the copies ranges from fuzzy to heavily blurred and is therefore virtually no longer legibel (compare Table I, Examples 6.1, 6.2, 7.1 and 7.2).

TABLE I

| Example | Total amount applied ($g.m^{-2}$) | Resin in material applied ($g.m^{-2}$) | Cetyl alcohol (% based on resin) | Sharpness according to BZ | IC according to BI | Resin: capsules ratio |
|---|---|---|---|---|---|---|
| 6 | 11.2 | 4.7 | 7 | 1 | 44 | 1:2 |
| 7 | 11.4 | 4.7 | 14 | 1 | 49.5 | 1:2 |
| 8 | 11.5 | 4.5 | 25 | 2 | 56 | 1:2 |
| 9 | 12.1 | 4.3 | 50 | 2 | 60 | 1:2 |
| 6.1 | 12.0 | 4.2 | 7 | 3 | 49.5 | 1:1 |
| 6.2 | 11.9 | 3.1 | 7 | 5 | 50.5 | 2:1 |
| 7.1 | 11.8 | 4.0 | 14 | 3 | 56 | 1:1 |
| 7.2 | 12.7 | 3.2 | 14 | 4 | 62 | 2:1 |

We claim:

1. A pressure-sensitive and heat-sensitive recording material comprising a carrier bearing a color-developing coating which reacts with color formers, wherein the color-developing coating consists essentially of (a) a finely divided solid phenol-isobutyraldehyde resin of the novolac type with spherical particles of size $\leqq 5\ \mu m$, (b) as the dispersant, one or more copolymers containing, as copolymerized units, ($\alpha$) from 5 to 95% by weight of a copolymerizable compound of the formula

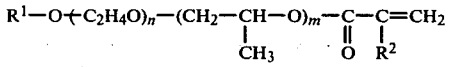

where $R^1$ is $C_8$–$C_{20}$-alkyl or unsubstituted or $C_1$–$C_{20}$-alkyl-substituted phenyl, $R^2$ is hydrogen or methyl, n is from 2 to 100 and m is from 0 to 50, ($\beta$) from 5 to 95% by weight of a copolymerizable ethylenically unsaturated $C_3$–$C_5$-carboxylic acid or of a sulfonic acid or phosphonic acid of 2 to 5 carbon atoms carrying a polymerizable ethylenically unsaturated group, and ($\gamma$) from 0 to 50% by weight of one or more copolymerizable ethylenically unsaturated compounds different from ($\alpha$) and ($\beta$), and (c) one or more aliphatic alcohols, which are solid at room temperature, of 12 to 18 carbon atoms, (a) together with (b) having been applied in the form of an aqueous or aqueous-organic secondary dispersion.

2. A recording material as claimed in claim 1, wherein (a) has a particle size of from 0.5 to 2 $\mu m$.

3. A recording material as claimed in claim 1, wherein the proportion of (b) is from 1 to 10% by weight, based on (a).

4. A recording material as claimed in claim 1, wherein (a) is a resin obtained by condensing phenol with isobutyraldehyde in a ratio of from 1:0.5 to 1:1.

5. A recording material as claimed in claim 1, wherein (b) is a copolymer of ($\alpha$) one or more acrylates or methacrylates of a reaction product of tallow alcohol, coconut alcohol or a $C_5$–$C_{18}$-alkylphenol with from 2 to 100 moles of ethylene oxide per mole of alcohol or phenol and ($\beta$) one or more copolymerizable acids from the group comprising acrylic acid, methacrylic acid and 2-acrylamido-2-methylpropanesulfonic acid.

6. A recording material as claimed in claim 1 or 5, wherein (b) is a copolymer which in addition to the comonomers ($\alpha$) and ($\beta$) contains, as copolymerized units, ($\gamma$) acrylamide, butyl acrylate, 2-ethylhexyl acrylate, hydroxypropyl acrylate, lauryl acrylate or a mixture of these.

7. A recording material as claimed in claim 1, wherein (b) is a copolymer of the acrylate of a reaction product of tallow alcohol with from 40 to 90 moles of ethylene oxide per mole of alcohol, acrylamide and 2-acrylamido-2-methylpropanesulfonic acid, or a copolymer of the acrylate of the reaction product of tallow alcohol with from 40 to 90 moles of ethylene oxide per mole of alcohol, lauryl acrylate and methacrylic acid, or a copolymer of the acrylate of the said tallow alcohol reaction product and methacrylic acid.

8. A recording material as claimed in claim 1, wherein (c) is cetyl alcohol or myristyl alcohol.

9. A recording material as claimed in claim 1, wherein the color developing coating contains, as additional agents conventional in such coatings, agents which influence the viscosity of the preparation, binders, white pigments, fillers or mixtures of these.

10. A recording material as claimed in claim 1 or 8, wherein the proportion of (c) is from 10 to 100% by weight, based on (a).

11. A recording material as claimed in claim 1 or 8, wherein the proportion of (c) is from 25 to 50% by weight, based on (a).

12. A recording material as claimed in claim 1, wherein the color-developing coating contains at least one microencapsulated color former.

* * * * *